US009980048B2

(12) United States Patent
Henderson et al.

(10) Patent No.: US 9,980,048 B2
(45) Date of Patent: May 22, 2018

(54) HEADBAND WITH SLING

(71) Applicant: Plantronics, Inc., Santa Cruz, CA (US)

(72) Inventors: Oliver W Henderson, Santa Cruz, CA (US); Erik Tews, Santa Cruz, CA (US); Matthew J Mainini, Santa Cruz, CA (US); Joseph W Yang, San Jose, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days. days.

(21) Appl. No.: 14/600,711

(22) Filed: Jan. 20, 2015

(65) Prior Publication Data

US 2016/0212519 A1 Jul. 21, 2016

(51) Int. Cl.
*H04R 25/00* (2006.01)
*H04R 5/033* (2006.01)

(52) U.S. Cl.
CPC ..... *H04R 5/0335* (2013.01)

(58) Field of Classification Search
CPC .. H04R 1/1091; H04R 5/0335; H04R 1/1066; H04R 5/033; H04R 1/105; H04R 1/10; H04R 2201/025; H04R 2201/10; H04R 1/00; H04R 2201/105; H04R 2209/024; H04R 25/02; H04S 7/304; G10K 2210/1081; H04M 1/05
USPC ..... 381/74, 378, 71.6, 309, 370, 371, 374, 381/345, 322
See application file for complete search history.

(56) References Cited

U.S. PATENT DOCUMENTS

| | | | | |
|---|---|---|---|---|
| 3,919,501 A | | 11/1975 | Cech et al. | |
| 5,574,795 A | * | 11/1996 | Seki | H04R 5/0335 381/370 |
| 5,619,584 A | * | 4/1997 | Lin | H04R 1/1066 381/370 |
| 6,724,906 B2 | * | 4/2004 | Naksen | H04R 1/1066 381/370 |
| 2009/0110226 A1 | * | 4/2009 | Ishida | H04R 1/1008 381/370 |

OTHER PUBLICATIONS

Unknown, "KOSS KTXPRO1 On-Ear Headphones," found at URL <http://www.koss.com/en/products/headphones/on-ear-headphones/KTXPRO1_KTXPRO1_On_Ear_Headphone>, on Oct. 22, 2014.

* cited by examiner

*Primary Examiner* — Norman Yu
(74) *Attorney, Agent, or Firm* — Chuang Intellectual Property Law

(57) ABSTRACT

Methods and apparatuses for headbands and headphones are disclosed. In one example, a headband includes an outer band and an inner band. The inner band includes an inner band left arm, an inner band right arm, and an elastic material coupled between the inner band left arm and the inner band right arm.

16 Claims, 5 Drawing Sheets

HEADBAND WITH SLING

BACKGROUND OF THE INVENTION

Head-worn devices such as headphones and headsets often utilize a headband which is worn over the user's head. The headband operates to support and position the earphones worn on the user's ears. In many cases, head-worn devices are worn for extended periods of time. Furthermore, head-worn devices may be worn in a variety of contexts, including situations where the user is in movement. As such, comfort, fit, and stability are critical to their design.

Since head-worn devices must be capable of being worn by a variety of users having different sized and shaped heads, a headband adjustment mechanism is typically provided. However, in the prior art, these adjustment mechanisms often do not provide the necessary adjustability to provide a comfortable, secure fit for a range of head sizes and shapes. As a result, improved methods and apparatuses for headbands for head-worn devices are needed.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Figure 1:
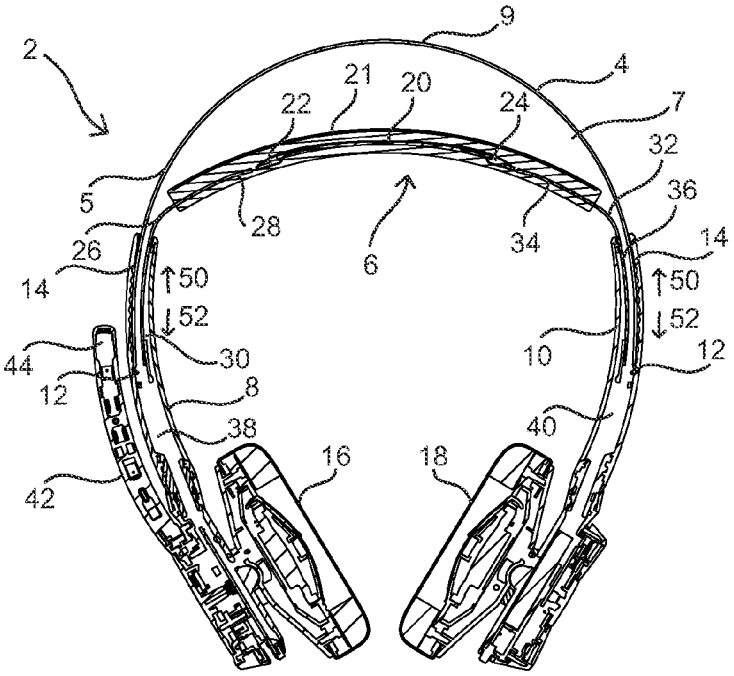
FIG. 1 illustrates a front view of a headphone in one example.

Methods and apparatuses for headbands and headphones are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein.

For purpose of clarity, details relating to technical material that is known in the technical fields related to the invention have not been described in detail so as not to unnecessarily obscure the present invention. It is to be understood that various example of the invention, although different, are not necessarily mutually exclusive. Thus, a particular feature, characteristic, or structure described in one example embodiment may be included within other embodiments unless otherwise noted.

The headband apparatuses described herein (referred to by the inventors as an "adaptable air cushion") advantageously combine both manual adjustment utilizing retractable headband arms and self-adjustment utilizing an elastic sling. In one example, the adaptable air cushion is a sling that also has adjustable arms. This allows the tension of the sling to be tuned to be comfortable on all head sizes because the adjustable arms allow for micro adjustment while the sling allows for gross adjustment. This prevents the sling tension from being too loose for smaller heads and too tight for larger heads, while allowing for a more precise firm fit than the adjustable arms can provide alone. The ability to conform to the individual's head shape means that more of the cushion is touching the user's head, displacing the weight of the headset over a larger surfaces area. In one example, the apparatuses and methods described solve the problem of fit and comfort of headsets from small to large heads, allowing for a headphone adjustable to fit head sizes from approximately the $5^{th}$ to the $95^{th}$ percentile.

In one example, a headband includes an outer band and an inner band. The inner band includes an inner band left arm, an inner band right arm, and an elastic material coupled between the inner band left arm and the inner band right arm. In one embodiment of the headband, the inner band is coupled to the outer band. The inner band further includes a head cushion, wherein the elastic material is disposed within the head cushion. In one embodiment, the headband is coupled to a left earphone assembly and a right earphone assembly. The left earphone assembly and the right earphone assembly are movably coupled to the headband to move bi-directionally along the outer band and the inner band. Specifically, the left earphone assembly is movably coupled to the headband in an arrangement to provide for a length adjustment between a center of the headband and an earcup assembly of the left earphone assembly. Similarly, the right earphone assembly is movably coupled to the headband in an arrangement to provide for a length adjustment between a center of the headband and an earcup assembly of the right earphone assembly. The left earphone assembly further includes a left tube configured to receive the inner band and the outer band. The right earphone assembly further includes a right tube configured to receive the inner band and the outer band.

In one example, a head-worn device includes a left earphone assembly, a right earphone assembly, and a headband. The headband has a first end coupled to the left earphone assembly and a second end coupled to the right earphone assembly. The headband includes an outer band and an inner band. The inner band includes an inner band left arm, an inner band right arm, and an elastic material coupled between the inner band left arm and the inner band right arm.

In one embodiment of the head-worn device, the inner band is coupled to the outer band. The inner band further includes a head cushion, wherein the elastic material is disposed within the head cushion. The head-worn device may further include a microphone boom.

The left earphone assembly and the right earphone assembly are movably coupled to the headband to move bi-directionally along the outer band and the inner band. The left earphone assembly is movably coupled to the headband in an arrangement to provide for a length adjustment between a center of the headband and an earcup assembly of the left earphone assembly. Similarly, the right earphone assembly is movably coupled to the headband in an arrangement to provide for a length adjustment between a center of the headband and an earcup assembly of the right earphone assembly.

In one embodiment, the left earphone assembly further includes a left tube assembly configured to receive the inner band and the outer band, and the right earphone assembly further includes a right tube assembly configured to receive the inner band and the outer band. A first terminal end of the inner band left arm is disposed within the left tube assembly and a second terminal end of the inner band left arm is coupled to the elastic material. In operation, the first terminal end of the inner band left arm is inserted further into the left tube assembly responsive to movement of the left earphone assembly in a first direction. In further operation, the first terminal end of the inner band left arm is withdrawn from the left tube assembly responsive to movement of the left earphone assembly in a second direction.

Similarly, a first terminal end of the inner band right arm is disposed within the right tube assembly and a second terminal end of the inner band right arm is coupled to the elastic material. In operation, the first terminal end of the inner band right arm is inserted further into the right tube assembly responsive to movement of the right earphone assembly in a first direction. In further operation, the first terminal end of the inner band right arm is withdrawn from the right tube assembly responsive to movement of the right earphone assembly in a second direction.

In one example, a head-worn device includes a left earphone assembly, a right earphone assembly, an outer band, and a sling band. The left earphone assembly includes a left earcup assembly, a left tube assembly, and a left earphone assembly coupling mechanism. The right earphone assembly includes a right earcup assembly, a right tube assembly, and a right earphone assembly coupling mechanism. The outer band has a left side including a left side coupling mechanism movably mated with the left earphone assembly coupling mechanism. The outer band has a right side including a right side coupling mechanism movably mated with the right earphone assembly coupling mechanism. The sling band includes a left sling arm coupled to the outer band on the left side of the outer band, and a right sling arm coupled to the outer band on the right side of the outer band. The sling band includes an elastic material coupled between the left sling arm and the right sling arm.

Figure 2:
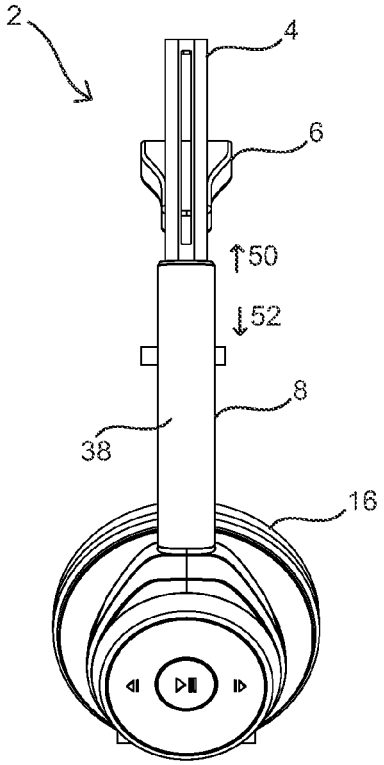
FIG. 2 illustrates a side view of the headphone shown in FIG. 1.

FIG. 1 illustrates a front view of a headphone 2 in one example. FIG. 2 illustrates a side view of the headphone shown in FIG. 1. Headphone 2 includes a left earphone assembly 8, right earphone assembly 10, outer band 4, and sling band 6. Headphone 2 further includes microphone boom 42 having microphone 44.

Figure 3:
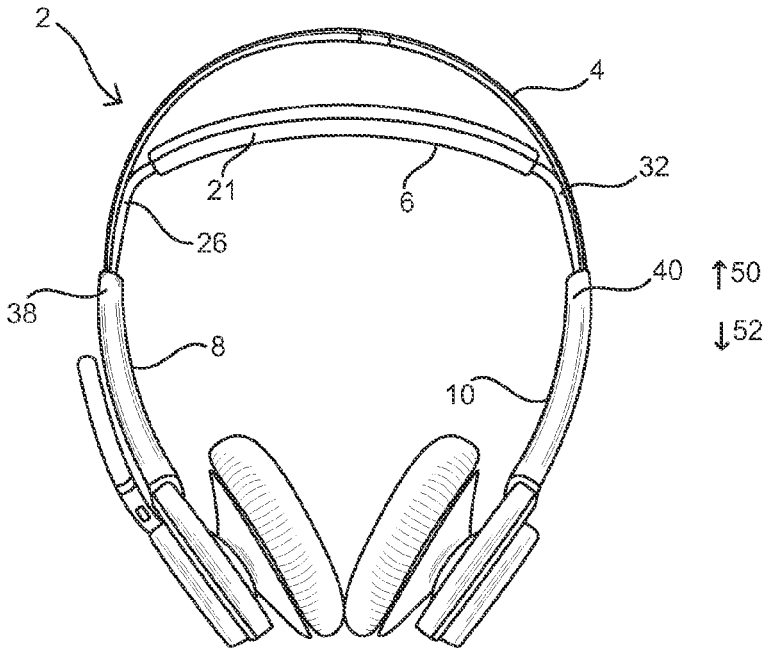
FIG. 3 illustrates the headphone shown in FIG. 1 in a fully extended use position.
Figure 4:
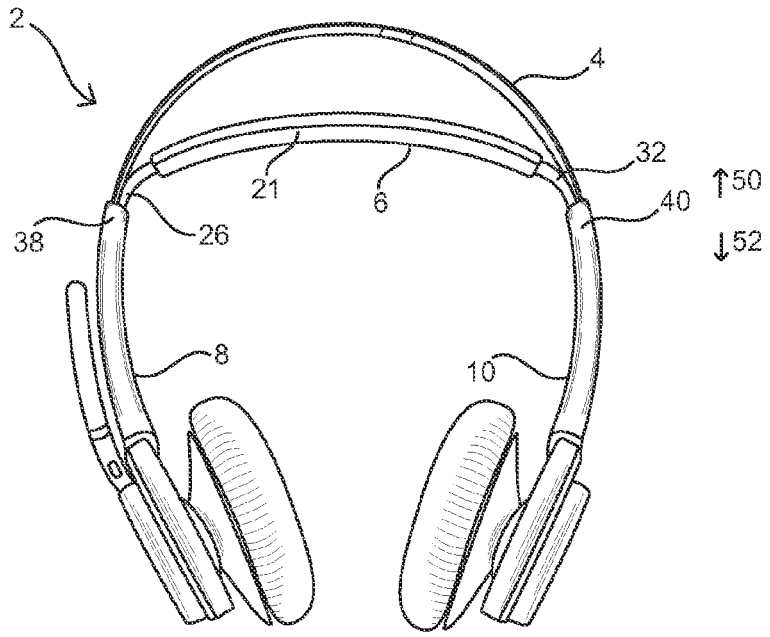
FIG. 4 illustrates the headphone shown in FIG. 1 in a fully retracted use position.

Referring to FIGS. 1-4, left earphone assembly 8 includes an earcup assembly 16, left tube assembly 38, and coupling mechanism 14. Coupling mechanism movably mates with an outer band 4 coupling mechanism 12, such that coupling mechanism 12 and coupling mechanism 14 provide for vertical length adjustment between the center 9 (i.e., the top) of outer band 4 and earcup assembly 16. In operation, left earphone assembly 8 is capable of movement along outer band 4 in a direction 50 towards the center 9 of outer band 4 until left earphone assembly 8 reaches a fully retracted position. FIG. 4 illustrates the left earphone assembly 8 of headphone 2 in a fully retracted use position.

Left earphone assembly 8 is capable of movement along outer band 4 in a direction 52 away from the center 9 of outer band 4 until left earphone assembly 8 reaches a fully extended position. FIG. 3 illustrates the left earphone assembly 8 of headphone 2 in a fully extended use position. As left earphone assembly 8 is moved towards the center 9 of outer band 4, the left terminal end of outer band 4 is inserted further into tube assembly 38 and as left earphone assembly 8 is moved away from the center 9 of outer band 4, the left terminal end of outer band 4 is moved in a withdrawal direction from tube assembly 38.

Right earphone assembly 10 includes an earcup assembly 18, right tube assembly 40, and coupling mechanism 14. Coupling mechanism 14 movably mates with an outer band 4 coupling mechanism 12, such that coupling mechanism 12 and coupling mechanism 14 provide for vertical length adjustment between center 9 of outer band 4 and earcup assembly 18. In operation, similar to left earphone assembly 8, right earphone assembly 10 is capable of movement along outer band 4 in a direction 50 towards the center 9 of outer band 4 until assembly 10 reaches a fully retracted position. FIG. 4 illustrates the right earphone assembly 10 of headphone 2 in a fully retracted use position.

Right earphone assembly 10 is capable of movement along outer band 4 in a direction 52 away from the center 9 of outer band 4 until assembly 10 reaches a fully extended position. FIG. 3 illustrates the right earphone assembly 10 of headphone 2 in a fully extended use position. As right earphone assembly 10 is moved towards the center 9 of outer band 4, the right terminal end of outer band 4 is inserted further into tube assembly 38 and as right earphone assembly 10 is moved away from the center 9 of outer band 4, the right terminal end of outer band 4 is moved in a withdrawal direction from tube assembly 40.

The earphone assemblies 8, 10 coupled to the outer band 4 includes a ball-and-socket type joint in which earcup assemblies 16, 18 are attached to the remainder of the assembly. This joint provides the earcup assemblies 16, 18 the ability for angular motion in all directions, thereby enabling them to adjust to any ear shape when placed on the user ear. In a further embodiment, a yoke style arrangement may be utilized.

Each earcup assembly 16, 18 includes an earphone (i.e., an audio transducer unit) disposed therein, and an ear cushion disposed on the outer housing for contact with the user ear when worn. The ear cushion operates both to provide comfort as well as serve the purpose of sealing around the user ear to keep in sound reproduced by the audio transducer unit. The shown left earphone assembly 8 and right earphone assembly 10 are merely one example among many which can be used with the outer band 4 and sling band 6.

Outer band 4 includes a left side 5 and a right side 7. Outer band 4 includes a coupling mechanism 12 on both left side 5 and right side 7 for movably mating with left earphone assembly 8 and right earphone assembly 10, respectively. The coupling mechanisms between earphone assemblies 8, 10 and the outer band 4 allow the headphone 2 to be manually size adjusted as desired by the user. In the example shown in FIG. 1, a detent based system is utilized. The outer band 4 at each end includes a wedge shaped detent which releasably engages one of corresponding depressions at the earphone assemblies 8, 10 designed to accommodate the wedge detent. Each earphone assembly 8, 10 can be gradually adjusted between each detent position, incrementally increasing or decreasing the distance between an assembly and the top of the user head as desired by the user. In operation, a user with a smaller head will position the earcup assembly to decrease this distance while a user with a larger head will position the earcup assembly to increase this distance. In further examples, alternative coupling mechanisms may be utilized providing a similar positioning/ adjustment flexibility. In one example, earphone assemblies 8, 10 are each adjustable by 24-28 millimeters.

Sling band 6 includes an elastic material 20, left sling arm 26, right sling arm 32, and a head cushion 21. The elastic material 20 is disposed within the head cushion 21. Elastic material 20 has a first end 22 and a second end 24. Left sling arm 26 has a first end 28 and a second end 30, where first end 28 is coupled to first end 22 of elastic material 20. Elastic material 20 is pulled/lengthened when the headband is placed on the wearer's head, exerting tension, and returns to its former shape/length when removed from the wearer's head. In one example, elastic material 20 is an elastomer having highly elastic properties. In one example, elastic material 20 is a woven elastic fabric or rubber band having a length of 20-70 millimeters and a stretch capability of 30%-115%. In a further example, elastic material 20 may be a spiral wound plastic spring or metal spring.

Second end 30 extends into left tube assembly 38. Second end 30 is attached to outer band 4 such that movement of left earphone assembly 8 along the length of outer band 4 results in corresponding movement of left earphone assembly 8 along left sling arm 26. In one example, sling band 6 is adjustable by 23-27 millimeters. In one example, left sling arm 26 and right sling arm 32 are formed from a compliant, low durometer molded elastomer, which complies and flexes to different head sizes.

The left sling arm 26 is arranged so that movement of the left earphone assembly 8 in a direction 50 results in insertion of the second end 30 further into the left tube assembly 38, and movement of the left earphone assembly 8 in a direction 52 results in movement in a withdrawal direction of the second end 30 from the left tube assembly 38.

Right sling arm 32 has a first end 34 and a second end 36. First end 34 is coupled to second end 24 of elastic material 20. Second end 36 extends into right tube assembly 40. Second end 36 is attached to outer band 4 such that movement of right earphone assembly 10 along the length of outer band 4 results in corresponding movement of right earphone assembly 10 along right sling arm 32.

The right sling arm 32 is arranged so that movement of the right earphone assembly 10 in a direction 50 results in insertion of the second end 36 further into the right tube assembly 40, and movement of the right earphone assembly 10 in a direction 52 results in movement in a withdrawal direction of the second end 36 from the right tube assembly 40.

Figure 5:
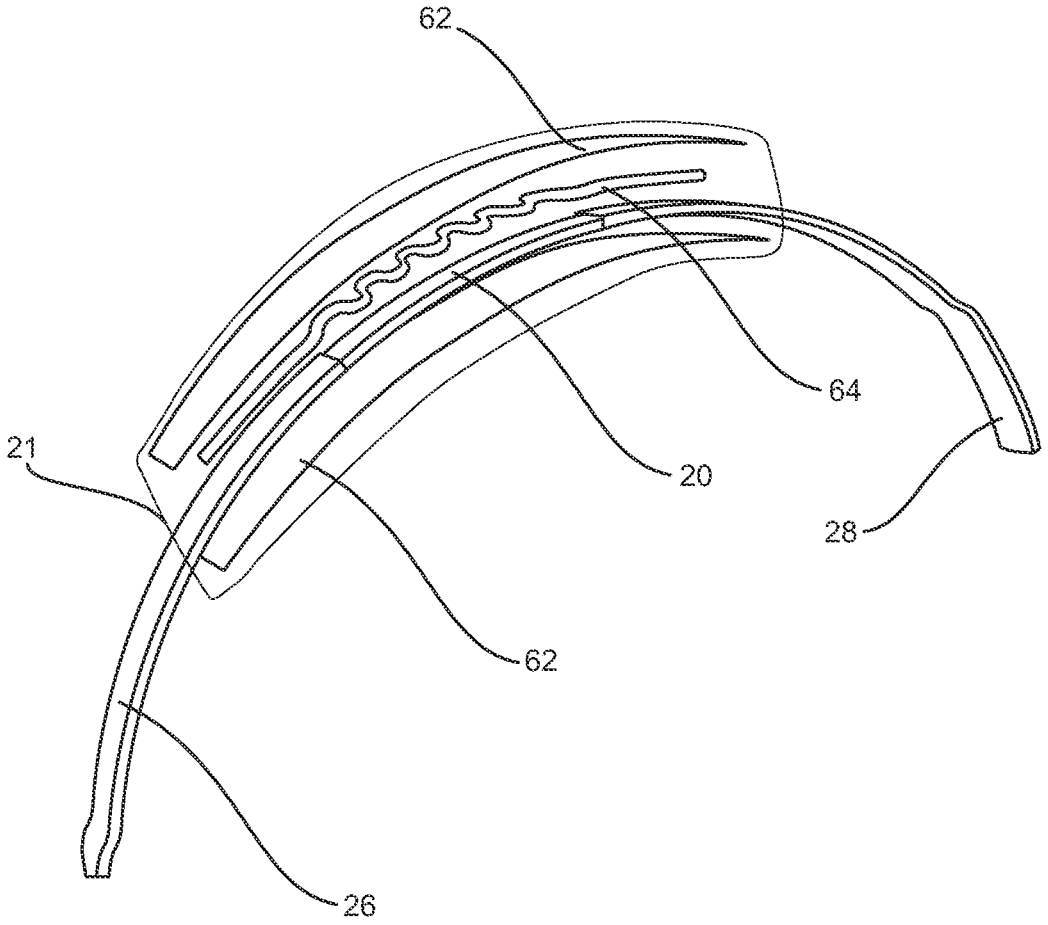
FIG. 5 illustrates a simplified diagram of the components of a sling band in one example.

FIG. 5 illustrates a simplified diagram of the components of the sling band 6 in one example. Sling band 6 includes the elastic material 20 coupled between the left sling arm 26 and the right sling arm 32. Elastic material 20 and wire 64 are disposed between sheet plastic 62. Elastic material 20 is disposed within head cushion 21. As shown in FIG. 5, head cushion 21 in one form factor is a fabric sleeve covering elastic material 20, wire 64, and sheet plastic 62. In one example, wire 64 is a duplex cable having elastic properties, whereby wire 64 and elastic material 20 act in parallel to provide a total combined elastic behavior of the sling band 6.

Figure 9:
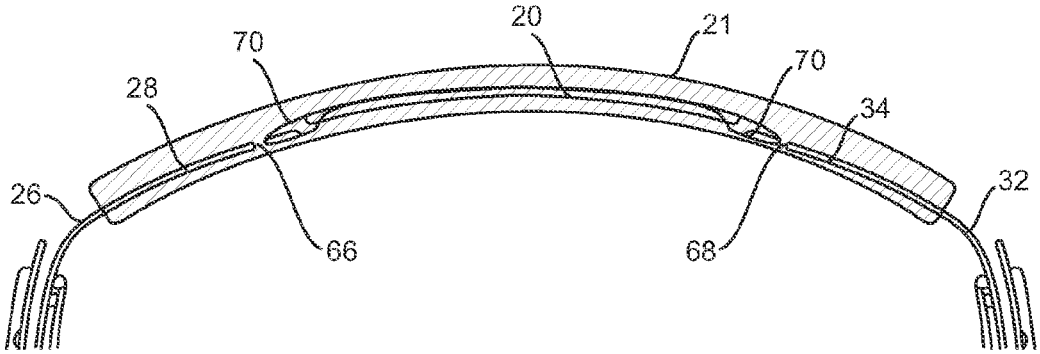
FIG. 9 illustrates coupling of the elastic material to the left sling arm and the right sling arm in one example.

FIG. 9 illustrates coupling of the elastic material 20 to the left sling arm 26 and the right sling arm 32 in one example. In this example, elastic material 20 is in the form factor of a loop 70 which loops through a through hole 66 at the end 28 of left sling arm 26 and a through hole 68 at the end 34 of the right sling arm 32, thereby coupling the elastic material 20 to the left sling arm 26 and right sling arm 32, respectively.

Referring again to FIGS. 1-4, outer band 4 is arcuately shaped curved to the shape of a user's head. The earcup assemblies 16, 18 are mounted onto the ends of the outer band 4 such that when worn by the user, the earcup assemblies 16, 18 are pressed against the ears with a fixed side pressure.

In operation, the sling band 6 is positioned on the wearer's head when the user puts on the headphone 2. The elasticity of sling band 6 allows it to self-adapt (i.e., automatically conform) to the wearer's head, accommodating a variety of head sizes. In addition to altering in length to ensure a proper fit, the sling band 6 provides a resilient inner force against the user head to hold the headphone 2 securely in place, the resilient inner force in response to the elastic material being stretched upwards (i.e., outwards). The head cushion 21 rests against the wearer's head. In one example, the head cushion 21 includes a base material of foam padding with an outer covering surface such as leather.

The manual adjustment provides for a wide range of motion, accommodating a wide range of head sizes. The self-adjustment provides for a precise, elastic fit. Advantageously, the headband utilizes the outer band 4 providing for manual adjustment in combination with the sling band 6 providing for self-adjustment, resulting in an unparalleled precise fit, comfort, and flexibility in accommodating a diversity of wearer head sizes. Also advantageously, unlike other headsets, the headset has multiple ideal settings in which it can be worn, which are fully adjustable by the user. The user can determine if they prefer a snugger/more stable fit by utilizing more sling and less arms, or alternatively a looser/lighter fit by utilizing more arms and less sling.

Figure 6:
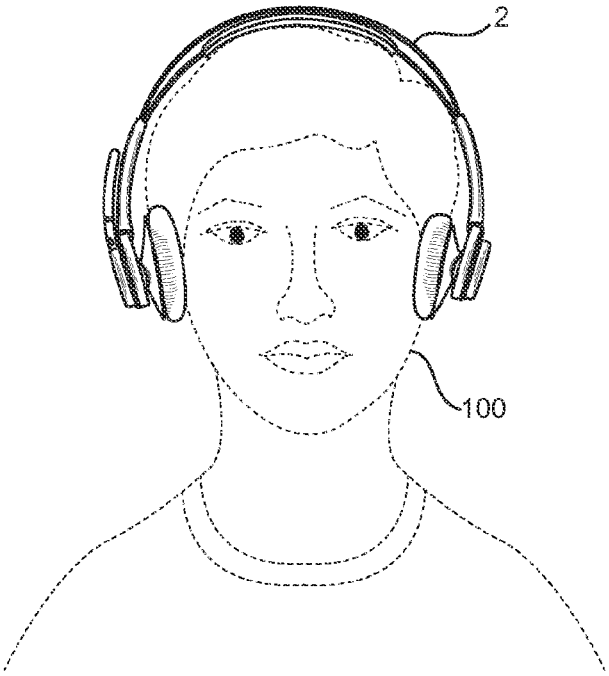
FIG. 6 illustrates a use case of the headphone shown in FIG. 1 in one example.

FIG. 6 illustrates a use case of the headphone 2 shown in FIG. 1 in one example. In the use case shown in FIG. 6, a user 100 with a larger sized head is shown wearing headphone 2. In this use case, earphone assemblies 8, 10 are manually adjusted by user 100 to a fully extended position. When placed on the user head, sling band 6 self-adjusts to the head of user 100, elastically stretching to accommodate the larger sized head.

Figure 7:
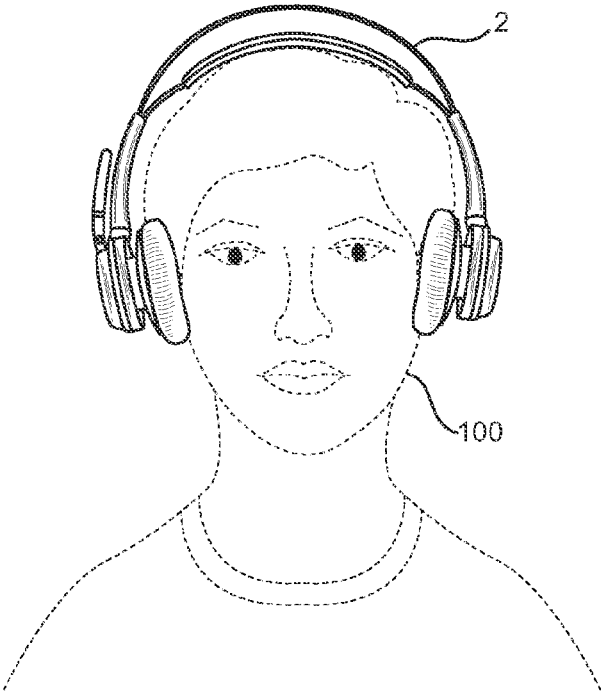
FIG. 7 illustrates a use case of the headphone shown in FIG. 1 in a further example.
Figure 8:
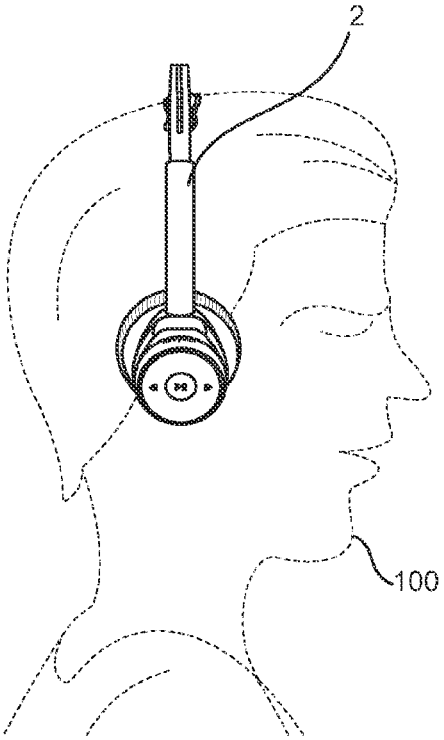
FIG. 8 illustrates a side view of the headphone shown in FIG. 1 worn on a user.

FIG. 7 illustrates a use case of the headphone 2 shown in FIG. 1 in a further example. In the use case shown in FIG. 6, a user 100 with a mid-sized head is shown wearing headphone 2. In this use case, earphone assemblies 8, 10 are manually adjusted by user 100 to a mid-point between a fully extended position and a fully retracted position. Again, when placed on the user head, sling band 6 self-adjusts to the head of user 100, this time accommodating the mid-sized head. FIG. 8 illustrates a side view of the headphone 2 worn on the user 100.

While the exemplary embodiments of the present invention are described and illustrated herein, it will be appreciated that they are merely illustrative and that modifications can be made to these embodiments without departing from the spirit and scope of the invention. Certain examples described utilize headphones which are particularly advantageous for the reasons described herein. In some instances, not all acts may be required to be implemented in a methodology described herein.

Thus, the scope of the invention is intended to be defined only in terms of the following claims as may be amended, with each claim being expressly incorporated into this Description of Specific Embodiments as an embodiment of the invention.

What is claimed is:

1. A head-worn device comprising:

a left earphone assembly;

a right earphone assembly;

a headband having a first end coupled to the left earphone assembly and a second end coupled to the right earphone assembly, the headband comprising:
an outer band; and
an inner band comprising:
an inner band left arm;
an inner band right arm; and
an elastic material coupled between the inner band left arm and the inner band right arm, wherein the left earphone assembly and the right earphone assembly are movably coupled to the headband to move bi-directionally on a length of both the outer band and the inner band, wherein the left earphone assembly further comprises a left tube assembly configured to receive the inner band and the outer band, and the right earphone assembly further comprises a right tube assembly configured to receive the inner band and the outer band.

2. The head-worn device of claim 1, wherein the inner band further comprises a head cushion, wherein the elastic material is disposed within the head cushion.

3. The head-worn device of claim 1, wherein the inner band is coupled to the outer band.

4. The head-worn device of claim 1, wherein the left earphone assembly is movably coupled to the headband in an arrangement to provide for a length adjustment between a center of the headband and an earcup assembly of the left earphone assembly.

5. The head-worn device of claim 1, wherein the right earphone assembly is movably coupled to the headband in an arrangement to provide for a length adjustment between a center of the headband and an earcup assembly of the right earphone assembly.

6. A head-worn device comprising:
a left earphone assembly;
a right earphone assembly;
a headband having a first end coupled to the left earphone assembly and a second end coupled to the right earphone assembly, the headband comprising:
an outer band; and
an inner band comprising:
an inner band left arm;
an inner band right arm; and
an elastic material coupled between the inner band left arm and the inner band right arm, wherein the left earphone assembly and the right earphone assembly are movably coupled to the headband to move bi-directionally along the outer band and the inner band,
wherein the left earphone assembly further comprises a left tube assembly configured to receive the inner band and the outer band, and the right earphone assembly further comprises a right tube assembly configured to receive the inner band and the outer band, and
wherein a first terminal end of the inner band left arm is disposed within the left tube assembly and a second terminal end of the inner band left arm is coupled to the elastic material, and wherein the first terminal end of the inner band left arm is inserted further into the left tube assembly responsive to movement of the left earphone assembly in a first direction, and wherein the first terminal end of the inner band left arm is withdrawn from the left tube assembly responsive to movement of the left earphone assembly in a second direction.

7. A head-worn device comprising:
a left earphone assembly;
a right earphone assembly;
a headband having a first end coupled to the left earphone assembly and a second end coupled to the right earphone assembly, the headband comprising:
an outer band; and
an inner band comprising:
an inner band left arm;
an inner band right arm; and
an elastic material coupled between the inner band left arm and the inner band right arm, wherein the left earphone assembly and the right earphone assembly are movably coupled to the headband to move bi-directionally along the outer band and the inner band,
wherein the left earphone assembly further comprises a left tube assembly configured to receive the inner band and the outer band, and the right earphone assembly further comprises a right tube assembly configured to receive the inner band and the outer band, and
wherein a first terminal end of the inner band right arm is disposed within the right tube assembly and a second terminal end of the inner band right arm is coupled to the elastic material, and wherein the first terminal end of the inner band right arm is inserted further into the right tube assembly responsive to movement of the right earphone assembly in a first direction, and wherein the first terminal end of the inner band right arm is withdrawn from the right tube assembly responsive to movement of the right earphone assembly in a second direction.

8. A head-worn device comprising:
an outer band; and
an inner band comprising:
an inner band left arm;
an inner band right arm; and
an elastic material coupled between the inner band left arm and the inner band right arm; and
a left earphone assembly movably coupled to move bi-directionally along a length of both the outer band and the inner band and a right earphone assembly movably coupled to move bi-directionally on a length of both the outer band and the inner band, wherein the left earphone assembly further comprises a left tube configured to receive the inner band and the outer band, and the right earphone assembly further comprises a right tube configured to receive the inner band and the outer band.

9. The head-worn device of claim 8, wherein the inner band further comprises a head cushion, wherein the elastic material is disposed within the head cushion.

10. The head-worn device of claim 8, wherein the inner band is coupled to the outer band.

11. The head-worn device of claim 8, wherein the left earphone assembly is movably coupled to the headband in an arrangement to provide for a length adjustment between a center of the headband and an earcup assembly of the left earphone assembly.

12. The head-worn device of claim 8, wherein the right earphone assembly is movably coupled to the headband in an arrangement to provide for a length adjustment between a center of the headband and an earcup assembly of the right earphone assembly.

13. A head-worn device comprising:
a left earphone assembly comprising:
a left earcup assembly;
a left tube assembly; and
a left earphone assembly coupling mechanism;

a right earphone assembly comprising:
a right earcup assembly;
a right tube assembly; and
a right earphone assembly coupling mechanism;
an outer band comprising:
a left side comprising a left side coupling mechanism movably mated with the left earphone assembly coupling mechanism, the left earphone assembly movable on a length of the outer band;
a right side comprising a right side coupling mechanism movably mated with the right earphone assembly coupling mechanism, the right earphone assembly movable on a length of the outer band; and
a sling band comprising:
a left sling arm coupled to the outer band on the left side of the outer band;
a right sling arm coupled to the outer band on the right side of the outer band; and
an elastic material coupled between the left sling arm and the right sling arm, wherein the left sling arm comprises a first left arm end and a second left arm end, the first left arm end coupled to the elastic material and the second left arm end disposed within the left tube assembly of the left earphone assembly, and the right sling arm comprises a first right arm end and a second right arm end, the first right arm end coupled to the elastic material and the second right arm end disposed within the right tube assembly of the right earphone assembly.

14. The head-worn device of claim 13, wherein the sling band further comprises a head cushion, wherein the elastic material is disposed within the head cushion.

15. A head-worn device comprising:
a left earphone assembly comprising:
a left earcup assembly;
a left tube assembly; and
a left earphone assembly coupling mechanism;
a right earphone assembly comprising:
a right earcup assembly;
a right tube assembly; and
a right earphone assembly coupling mechanism;
an outer band comprising:
a left side comprising a left side coupling mechanism movably mated with the left earphone assembly coupling mechanism;
a right side comprising a right side coupling mechanism movably mated with the right earphone assembly coupling mechanism; and
a sling band comprising:
a left sling arm coupled to the outer band on the left side of the outer band;
a right sling arm coupled to the outer band on the right side of the outer band; and
an elastic material coupled between the left sling arm and the right sling arm,
wherein:
the left sling arm comprises a first left arm end and a second left arm end, the first left arm end coupled to the elastic material and the second left arm end disposed within the left tube assembly of the left earphone assembly, and
the right sling arm comprises a first right arm end and a second right arm end, the first right arm end coupled to the elastic material and the second right arm end disposed within the right tube assembly of the right earphone assembly,
and wherein:
the left sling arm is arranged so that movement of the left earphone assembly in a first direction results in insertion of the second left arm end further into the left tube assembly, and movement of the left earphone assembly in a second direction results in withdrawal of the second left arm end from the left tube assembly, and
the right sling arm is arranged so that movement of the right earphone assembly in a first direction results in insertion of the second right arm end further into the right tube assembly, and movement of the right earphone assembly in a second direction results in withdrawal of the second right arm end from the right tube assembly.

16. The head-worn device of claim 13, wherein movement of the left earphone assembly along a length of the outer band results in corresponding movement along a length of the left sling arm, and movement of the right earphone assembly along a length of the outer band results in corresponding movement along a length of the right sling arm.

* * * * *